US005684267A

United States Patent [19]

Dean

[11] Patent Number: 5,684,267

[45] Date of Patent: Nov. 4, 1997

[54] RESUPPLY PROJECTILE

[75] Inventor: Charles E. Dean, Bloomfield, N.J.

[73] Assignee: The United States of Americas as represented by the Secretary of the Army, Washington, D.C.

[21] Appl. No.: 794,793

[22] Filed: Feb. 4, 1997

Related U.S. Application Data

[60] Provisional application No. 60/029,618, Oct. 25, 1996.

[51] Int. Cl.[6] ..... F42B 12/62

[52] U.S. Cl. ..... 102/489; 102/293; 102/357; 102/393; 102/502

[58] Field of Search ..... 102/293, 340, 102/342, 351, 357, 393, 489, 502, 517; 244/137.3, 137.4

[56] References Cited

U.S. PATENT DOCUMENTS

| | | | |
|---|---|---|---|
| 2,408,246 | 9/1946 | Walter | 244/138 R |
| 3,677,182 | 7/1972 | Peterson | 102/517 |
| 4,023,495 | 5/1977 | Fischer et al. | 102/342 |
| 4,226,185 | 10/1980 | Tobler et al. | 102/342 |
| 4,991,513 | 2/1991 | Malamas et al. | 102/489 |
| 5,003,881 | 4/1991 | Herold et al. | 102/340 |
| 5,111,748 | 5/1992 | Thurner et al. | 102/489 |

OTHER PUBLICATIONS

"Artillery Launched Television" by Ohlhoff et al, Aerial Reconnaissance Systems, SPIE vol. 79 (1976) pp. 183–188.

*Primary Examiner*—Harold J. Tudor
*Attorney, Agent, or Firm*—Michael C. Sachs

[57] ABSTRACT

A resupply projectile is described which can deliver critical logistic supplies rapidly and accurately to forward combatants with minimum risk to supply personnel or equipment and which is not hampered by either weather or terrain.

7 Claims, 4 Drawing Sheets

RESUPPLY PROJECTILE

GOVERNMENTAL INTEREST

The invention described herein may be manufactured, used and licensed by or for the United States Government.

This application is a continuation-in-part of provisional U.S. application Ser. No. 60/029,618 filed Oct. 25, 1996, now abandoned.

BACKGROUND OF THE INVENTION

A need has existed for a very long time to quickly, accurately and safely deliver logistical supplies to ground combat personnel that have been separated from their normal resupply sources. The lack of critical supplies to combatants may lead to unnecessary loss of life, equipment, and the effectiveness of other dependent units. Shortages in ammunition during combat frequently force ground personnel to break off engagement, restrict weapons fire, surrender, or become a casualty. For a wounded soldier, rapid resuscitation by having fluid replacement is usually crucial to saving life. The primary goal of combat trauma medicine is to reach the wounded with sufficient resuscitation capability within the first fifteen minutes of wounding.

The present method of resupply of combat logistics to embattled units by means of parachute drops or by helicopters that fly directly to the battle area are all restricted by weather, terrain and enemy action.

The present invention utilizes supporting artillery to provide an extremely rapid means of cargo delivery that does not risk injury to personnel or equipment.

SUMMARY OF THE INVENTION

The present invention relates to a resupply projectile which can rapidly and accurately deliver supplies to embattled combatants with minimum risk to supply personnel or transport equipment.

An object of the present invention is to deliver critical supplies to forward ground units by fitting parachute-equipped resupply canisters inside artillery shells.

Another object of the present invention is to utilize a 155 mm ammunition resupply projectile to rapidly deliver small arms ammunition to embattled combat forces.

Another object of the present invention is to utilize a medical resupply projectile to rapidly and accurately deliver bags of intravenous fluid.

Another object of the present invention is to deliver critical supplies to forward combatant forces rapidly, accurately and safely without being impeded by enemy forces, terrain or weather.

A further object of the present invention is to deliver critical supplies to combatant-friendly forces without enemy knowledge.

For a better understanding of the present invention, together with other and further objects thereof, reference is made to the following descriptions taken in connection with the accompanying drawings.

BRIEF DESCRIPTION OF THE DRAWINGS

Throughout the following description, like numerals are used to denote like parts of the drawings.

DETAILED DESCRIPTION OF THE PREFERRED EMBODIMENTS

Figure 1:
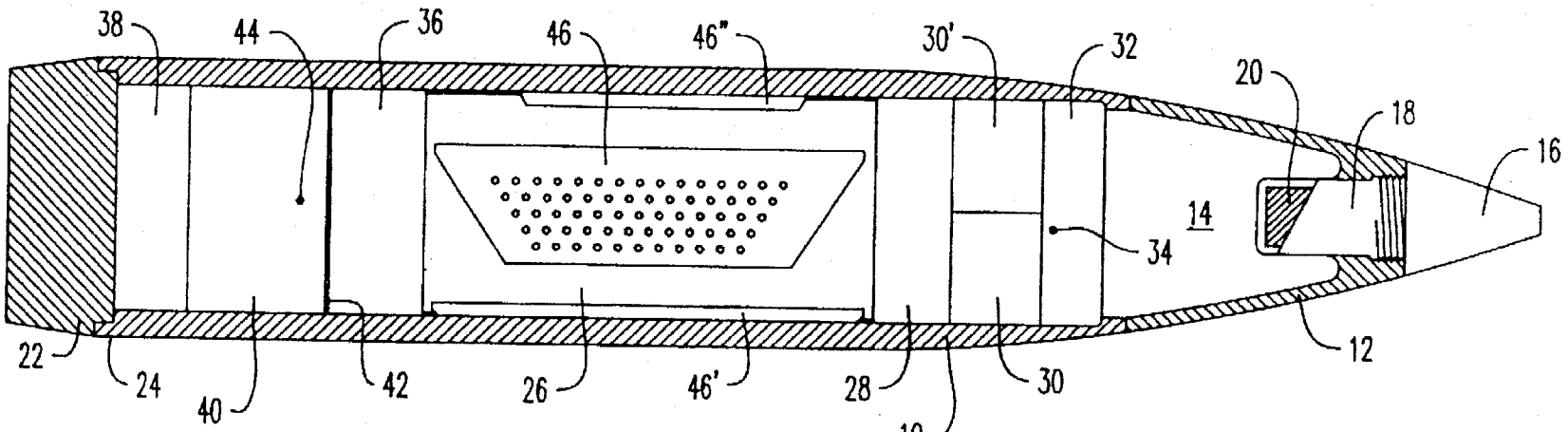
FIG. 1 is a diametral, longitudinal cross-sectional view and cut-away view of a resupply projectile.

Referring now to FIG. 1, the resupply artillery projectile comprises a main body 10 having an ogive section 12 with an ogive body space 14 located therein. A fuse 16 is threadedly attached to ogive 12. The fuse 16 operatively includes an expulsion fuse cap 18 which holds therein an expulsion explosive charge 20. A projectile base plug 22 is threadedly attached to the rear end 24 of the projectile body 10. A resupply canister 26 is slidably positioned in the projectile body 10 which includes a forward end assembly having a forward spacer ring 28 in juxtaposition with a pair of locking rings 30 and 30'. A removable end cap 32 is operatively held by four end cap pins 34 to the forward end of canister 26. Only one of the four end cap pins 34 is shown in FIG. 1. A rear canister spacer ring 36 in cooperation with the forward canister spacer ring 28 hold resupply canister 26 in a coaxial position within the projectile body 10. A drogue and main parachute are operatively positioned within drogue and main parachute steel covers 38 and 40, respectively.

A canister fixed end cap 42 is positioned intermediate the rear canister spacer ring 36 and the main parachute steel cover 40. Steel cover 40 includes a pair of piston stopping pins 44 whose function will be described in more detail hereinafter. Three counter-rotational fins 46, 46', and 46" are on an edge welded to the outer surface of canister 26. The welded side is parallel to the longitudinal axis of the projectile body 10 and the canister 26.

Figure 2:
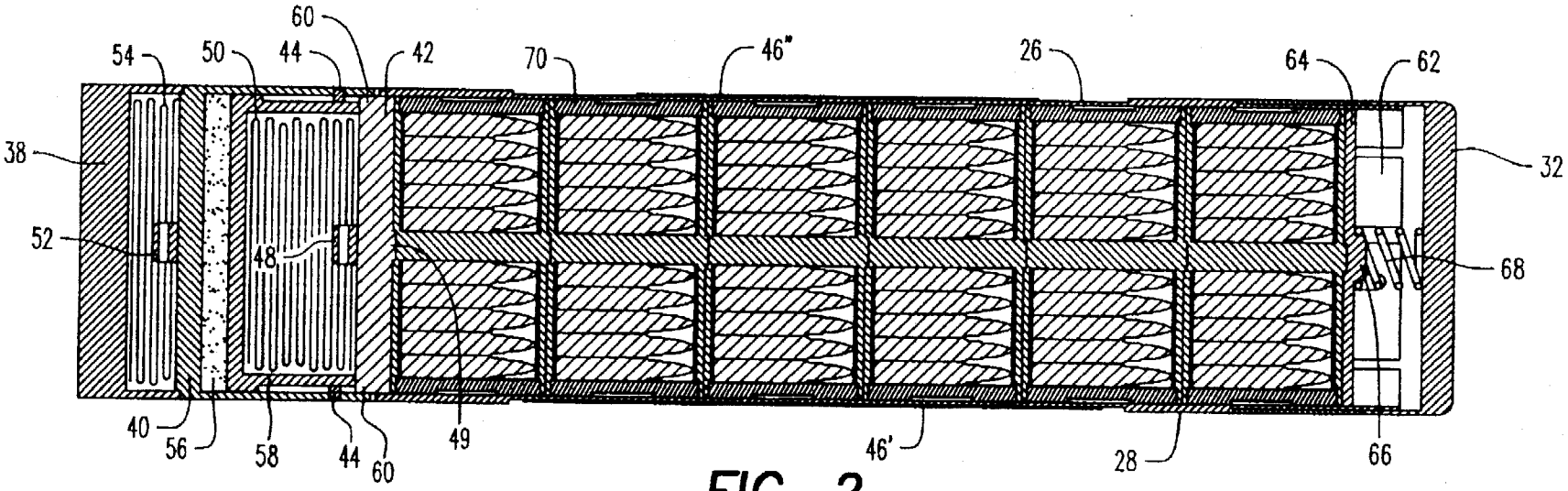
FIG. 2 is a diametral, longitudinal cross-sectional view of an ammunition resupply canister.

Referring now to FIG. 2, the resupply ammunition canister includes the cylindrical steel canister can 26 having a parachute deployment system operatively connected to fixed end cap 42. Fixed end cap 42 has a main parachute swivel 48 on its rear end outside surface and a tongue 49 located on its inside cover surface for positioning either ammunition or medical cargo carriers. The parachute deployment system includes the centrally located main swivel attachment 48 which is connected to the rear end of fixed end cap 42. Swivel 48 allows main parachute 50 to be attached to the loaded canister 26.

In a similar fashion, drogue swivel attachment 52 is operatively connected to main parachute steel cover 40. Swivel 52 is connected to drogue parachute 54. Swivel 52 allows the drogue parachute 54 to be deployed when the drogue steel cover 38 is explosively removed by a timer charge 56. Timer charge 56 is located intermediate the inside surface of main parachute steel cover 40 and a piston assembly 58. Piston assembly 58 separates the drogue parachute 54 from the canister 26 during deployment of the main parachute 50. The drogue and main parachute steel covers 38 and 40, respectively, keep the parachutes properly packed until used, and they protect the parachutes during the initial phases of canister expulsion from the projectile. Steel cover 40 is removably attached to fixed end cap 42 by four shear retaining pins 60. Drogue cover 38 and main parachute cover 40 keep the parachutes properly packed until used, and they protect the parachutes during the initial phases of canister expulsion from the projectile. The slotted forward end 62 of canister 26 slidably supports end cap 32 thereon and also holds locking plate 64 therein. A centrally positioned locking plate boss 66 axially aligns spring 68 between the removable end cap 32 and the locking plate 64. As many as six ammunition submagazines 70 may be stacked one on top of each other, holding approximately 516 rounds of 5.56 mm ammunition.

Figure 4:
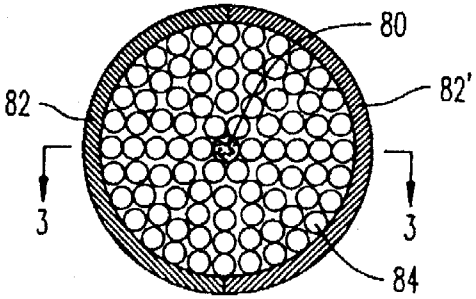
FIG. 4 is a cross-sectional view of the ammunition submagazine taken along line 4—4 of FIG. 3.
Figure 3:
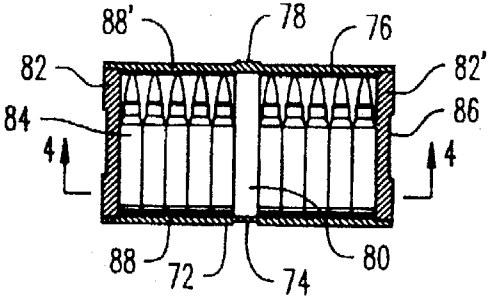
FIG. 3 is a cross-sectional view of an ammunition submagazine taken along line 3—3 of FIG. 4.
Figure 11:
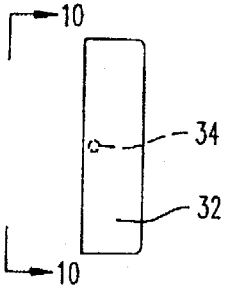
FIG. 11 is a side view of the removable end cap shown in FIGS. 7 and 10.
Figure 10:
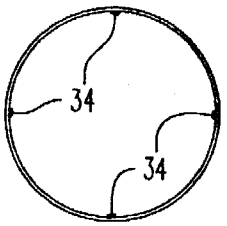
FIG. 10 is a plan view of the removable canister end cap taken along line 10—10 of FIG. 11.
Figure 9:
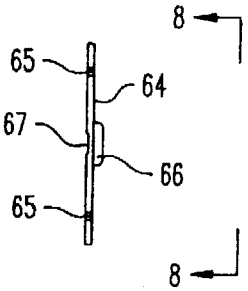
FIG. 9 is a side view of the locking plate shown in FIG. 8.
Figure 8:
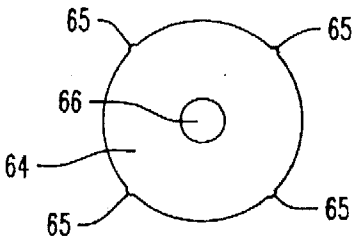
FIG. 8 is a plan view of the locking plate aforedescribed taken along line 8—8 of FIG. 9.
Figure 7:
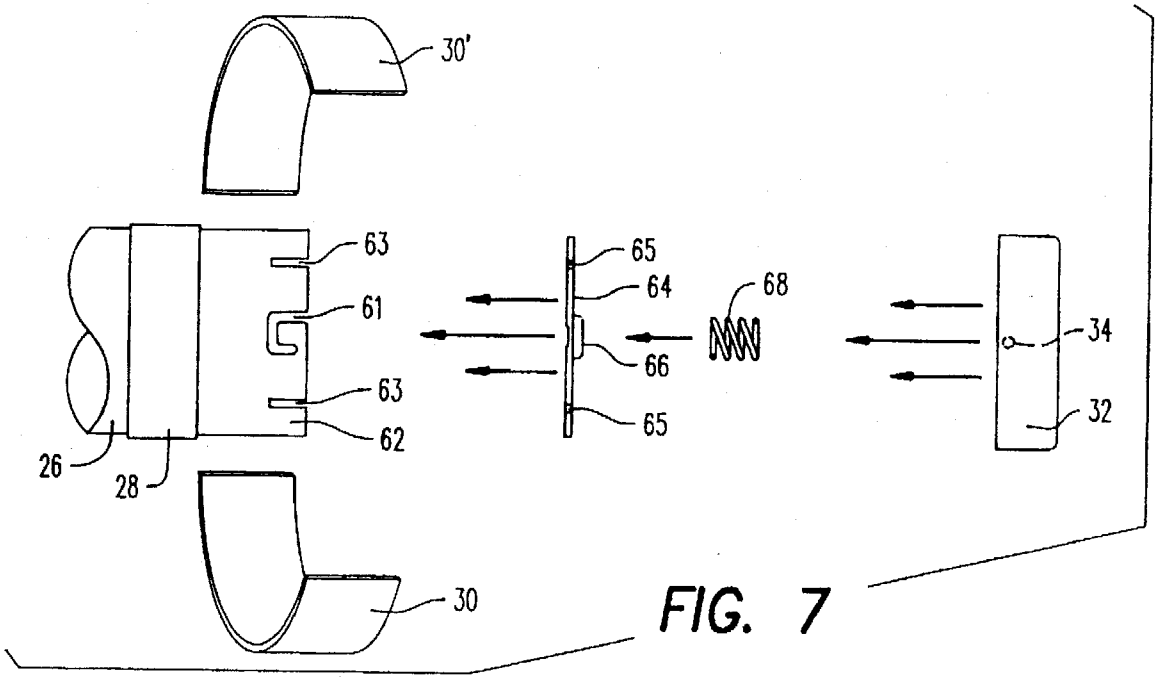
FIG. 7 is an exploded view of the resupply canister forward slotted end with two semi-cylindrical locking rings, locking plate, locking spring and canister removable end cap in their respective positions prior to assembly.

Referring now to FIGS. 3 and 4, the ammunition submagazine 70 comprises a steel circular bottom end cap 72 having a groove 74 therein which mates with the fixed end cap tongue 49 and the steel tongue 78 of a circular top end cap 76. The steel end caps 72 and 76 are held apart by a steel column 80. Two semi-circular spacer walls 82, 82' form the sides of the ammunition submagazine 70. The 5.56 mm bullets 84 are loaded into the submagazine 70 and held in place by their bodies contacting one another. The side walls 82, 82' are held in place with adhesive tape, not shown, wrapped around the wall side groove 86. The bullets 84 can face either into or away from the direction of flight. A pair of neoprene rubber pads 88, 88' positioned intermediate the bullets 84, and the inside surfaces of end caps 72 and 76 soften the bullet contact with end caps 72 and 76. Adjacent submagazines lock together with the steel tongue 78 milled or cast on end cap 76 and a corresponding end cap groove 74 milled or cast into end cap 72. The column of loaded magazines 70 are locked into the resupply canister 26 by a locking plate groove 67 in locking plate 64 and the tongue 49 on the fixed end cap 42.

Figure 6:
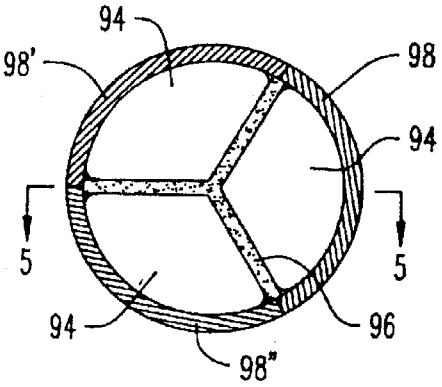
FIG. 6 is a cross-sectional view of the medical supply submagazine taken along line 6—6 of FIG. 5.
Figure 5:
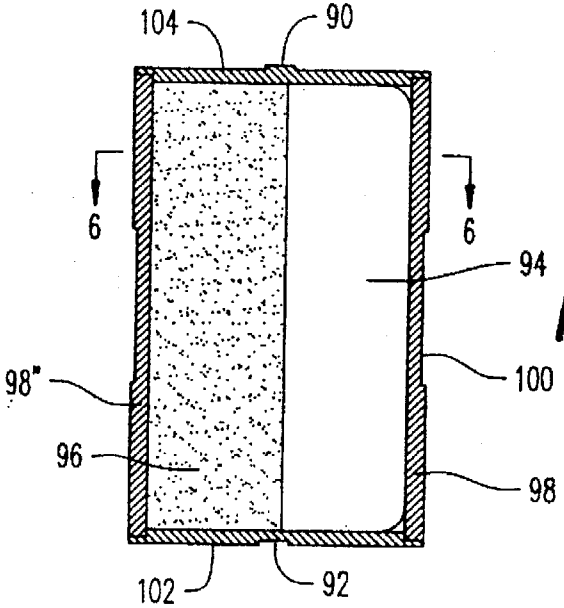
FIG. 5 is a cross-sectional view of a medical resupply submagazine taken along line 5—5 of FIG. 6.

Referring now to FIGS. 5 and 6, these drawings show how the resupply canister can be loaded with other types of cargo. In this instance, two medical fluid submagazines can fit inside the resupply canister 26. The medical submagazines lock together and into canister 26 with a similar tongue 90 and groove 92 system as aforedescribed for the small arms ammunition submagazines 70. Each medical fluid submagazine of FIGS. 5 and 6 carries three 500 ml bags 94. The fluid bags 94 are held in place by a three-finned, non-metallic spacer 96. Three steel spacer walls 98, 98' and 98" form the cylindrical wall of the medical fluid submagazine. The spacer walls 98, 98' and 98" are held in place by adhesive tape, not shown, wrapped around wall groove 100. A bottom end cap 102 having groove 92 therein and a top end cap 104 having a tongue therein completes the medical submagazine structural elements. All empty spaces surrounding the sterile fluid bags 94 are filled with water. The water offsets pressure rises within the fluid bags to prevent bag rupture during projectile launch from a cannon.

Referring now to FIGS. 7–11, the forward end 62 of canister 26 supports the removable end cap 32 which has four inwardly protruding pins 34 in the end cap side wall. After loading canister 26 with either of the aforementioned submagazines and prior to placing the removable end cap 32 into canister 26, a locking plate 64 is inserted into the open end of canister 26. Locking plate 64 supports on its peripheral edge four locking plate keys 65 spaced ninety degrees apart. The locking plate keys 65 slide into four aligned canister key ways 63. Spring 28 is then positioned onto the locking plate boss 66, and the spring 68 is compressed by end cap 32. Pins 34 allow the removable end cap 32 to lock onto the canister open slotted end 62 by the cap pins 34 sliding along four operatively aligned "J" shaped canister slots 61. The internal spring 60 forces pins 34 of end cap 32 to lock into the "J" slots 61. The two locking rings 30, 30' keep the removable end cap 32 from moving with respect to canister 26 when the canister 26 is loaded into the artillery shell body 10.

In operation, to resupply a combat unit with logistics, an artillery projectile is typically fired from a 155 mm cannon. The shell shown in FIG. 1 travels toward its intended target. When the shell is in proximity of the target, fuse 16 functions causing the expulsion charge 20 within the expulsion cup 18 to explode. The explosion creates within the artillery shell's ogive 14 a high pressure wave. A large force, caused by this pressure wave, pushes against the exposed surface of the removable end cap 32. The locking rings 30 and 30' keep the removable end cap 32 from moving with respect to the rest of the resupply canister 26 and the force is thus transferred along the length of the resupply canister 26 until the canister pushes against the base plug 22. The threads on the base plug 22 that had secured it to the shell body rear end 24 are sheared off due to the large axial explosive force exerted against them. The base plug 22 is pushed out of the shell body rear end 24, followed by the resupply canister 26. As canister 26 departs the shell base end 24, four actions occur. First, the skin friction drag forces caused by the spinning canister 26 entering the air stream force the three counter-rotational fins 46, 46' and 46" to deploy and to de-spin the canister 26. Second, the drogue parachute cover 38 for the drogue parachute 54 falls aside, and the drogue parachute 54 deploys and begins to slow the forward speed of the resupply canister 26. Third, the two locking rings 30, 30' spin free of canister 26. And lastly, the expulsion of the resupply canister 26 from the shell body 10 initiates an electrical timer, not shown, that will cause the main parachute explosive charge 56 to detonate a set time later. As the canister 26 approaches its ground target, explosive charge 56 detonates, causing a pressure wave in its chamber that simultaneously applies equal forces to the main parachute cover 40 and the piston 58. As the main parachute cover 40 is forced away from the resupply canister 26, it shears the four retaining pins 60. The explosive force from charge 56 causes the piston 58 and the main parachute cover 40 to move in opposite directions to one another until the travel of piston 58 is stopped by pins 44. At this point, piston 58 will move with main parachute cover 40, and the cover 40 along with the piston 58 and the drogue parachute 54 will fly free of the resupply canister 26. Due to this action, the main parachute 50 will begin to deploy. As the resupply canister 26 approaches the ground target, the main parachute 50 will slow the canister 26 descent speed significantly to prevent damaging the cargo upon ground impact. When canister 26 lands on the ground, combat personnel will recover it and take off the removable end cap 32 by hand by simply pushing in on end cap 32, compressing spring 68, and twisting cap 32 so that pins 34 slide out of the "J" groove 61. The submagazines will be removed by inverting the canister 26. Their contents will then be reached by cutting or peeling off the adhesive tape aforementioned.

While a specific embodiment of the invention has been shown and described in detail to illustrate the application of the principles of the invention, it will be understood that the invention may be embodied otherwise without departing from such principles.

What is claimed is:

1. An artillery projectile used for resupply of items by firing the projectile to distant troops whereby such items are carried inside said projectile, said projectile comprising:

shell body means for holding logistic supplies therein, having the capability of rapidly and accurately transporting said supplies to forward disposed combatants without interference of weather, terrain or enemy action, said shell body including:

a projectile base plug threadedly attached to a rear end of said shell body means;

an ogive operatively disposed on a forward end of said shell body means for holding fuse means thereto, said ogive having an ogive space located therein; and canister means for holding said logistic supplies in said shell body means so that said supplies can safely be delivered, said canister means including:

a hollow, cylindrically shaped steel canister body having a slotted open forward end and a fixed closed rear end cap operatively connected to said canister body;

a circular locking plate having a locking plate boss axially positioned on a forward side, a locking plate groove operatively located on a rear side of said locking plate, and a plurality of locking plate keys extending from a peripheral edge of said locking plate, said locking plate slidably disposed in said open slotted forward end;

a removable end cap having a plurality of pins located in a side wall of said end cap for operatively engaging and removably locking said end cap to said canister slotted forward end;

a spring, operatively compressed intermediate said locking plate and said removable end cap;

a pair of semicircular locking rings positioned adjacent to said removable end cap; and a forward spacer ring in juxtaposition with said locking rings;

said fuse means initiating the expulsion of said canister means from said shell body means at the proper time; said fuse means including:

an expulsion charge cap means for holding an explosive charge therein;

parachute means for separating said canister means from said shell body means and safely delivering said canister means to a specific target area; and fin means for de-spinning said canister after said canister is separated from said shell body when said canister is over said target area.

2. A projectile as recited in claim 1 wherein said canister means includes:

a plurality of ammunition submagazines operatively disposed intermediate said closed canister rear end cap and said locking plate.

3. A projectile as recited in claim 2 wherein said parachute means includes:

a main parachute steel cover releaseably pinned to said fixed end cap;

a plurality of shear pins operatively holding said main parachute steel cover to said fixed end cap;

piston means slidably disposed in said main parachute steel cover;

a main swivel operatively disposed on a rear end of said fixed end cap;

a main parachute operatively connected to said main swivel;

a plurality of piston stopping pins fixedly disposed on said main parachute steel cover;

a timer explosive charge operatively located intermediate said main parachute steel cover and a rear end of said piston means;

a drogue parachute steel cover releaseably attached to the rear end of said main parachute steel cover;

a drogue swivel attachment operatively connected to the rear end of said main parachute cover; and a drogue parachute operatively located in said drogue steel cover and attached to said drogue swivel.

4. A projectile as recited in claim 3 wherein said fin means comprises:

a plurality of counter rotational fins welded on one edge of each fin so that the welded side of said fins is positioned parallel to a longitudinal axis of said shell body means and said canister means.

5. A projectile as recited in claim 4 wherein said canister means includes:

a plurality of medical fluid holding submagazines operatively disposed intermediate said closed canister rear end cap and said locking plate.

6. A projectile as recited in claim 4 wherein each submagazine comprises:

a circular magazine bottom end cap having a groove on an outer surface;

a circular magazine top end cap having a tongue on an outer surface;

a plurality of semi-circular spacer walls having a groove therein;

an axially positioned steel column member positioned intermediate said magazine bottom end cap and said magazine top end cap; and a pair of neoprene pads positioned intermediate the inside surfaces of said bottom and top magazine end caps for softening the contact between the ammunition contained therein and the submagazine structure.

7. A projectile as recited in claim 5 wherein said medical fluid holding magazine comprises:

three partial cylindrically shaped spacer walls having a wall groove in an outer surface;

a grooved bottom end cap a tongued top end cap; and a three finned spacer operatively disposed within said spacer walls intermediate said bottom and top end caps.

* * * * *